US007878487B2

(12) United States Patent
Pearson

(10) Patent No.: US 7,878,487 B2
(45) Date of Patent: Feb. 1, 2011

(54) UNIVERSAL RETAINING LOCK FOR CHAIN LINK FENCE SLATS

(75) Inventor: Jim Pearson, Fort Meade, FL (US)

(73) Assignee: Extruders Unlimited, Inc., Ft. Meade, FL (US)

( * ) Notice: Subject to any disclaimer, the term of this patent is extended or adjusted under 35 U.S.C. 154(b) by 131 days.

(21) Appl. No.: 12/337,161

(22) Filed: Dec. 17, 2008

(65) Prior Publication Data

US 2010/0148140 A1 Jun. 17, 2010

(51) Int. Cl.
*E04H 17/02* (2006.01)

(52) U.S. Cl. ..... 256/34; 256/22

(58) Field of Classification Search ..... 256/32, 256/34, 22; 403/263, 353
See application file for complete search history.

(56) References Cited

U.S. PATENT DOCUMENTS 1,664,080 A * 3/1928 Mapson ..... 256/22
1,757,686 A * 5/1930 Rosenbaum ..... 256/19
2,760,759 A 8/1956 Rice
3,083,951 A * 4/1963 Huret ..... 256/65.08
3,485,006 A * 12/1969 De Rozario ..... 256/65.01
3,958,794 A * 5/1976 Suprunuk et al. ..... 256/34
3,973,756 A * 8/1976 Lauzier ..... 256/21
4,027,855 A * 6/1977 Lauzier ..... 256/21
4,085,954 A 4/1978 Thompson
4,723,761 A 2/1988 Cluff
4,725,044 A * 2/1988 Cluff ..... 256/34
4,950,098 A * 8/1990 Abbott et al. ..... 403/34
4,995,591 A * 2/1991 Humphrey et al. ..... 256/34
5,007,619 A 4/1991 Sibeni
5,165,664 A * 11/1992 Cluff ..... 256/34
5,234,199 A * 8/1993 Cluff ..... 256/34
5,465,941 A * 11/1995 Abbott ..... 256/34
6,237,299 B1 * 5/2001 Gortan ..... 52/693
6,634,623 B2 * 10/2003 Torres ..... 256/34
6,966,547 B2 * 11/2005 Colliander ..... 256/32
7,360,754 B2 * 4/2008 Robbins ..... 256/65.12
2002/0113232 A1 * 8/2002 Torres ..... 256/34
2005/0133775 A1 * 6/2005 Campbell ..... 256/32

* cited by examiner

*Primary Examiner*—Joshua T Kennedy
(74) *Attorney, Agent, or Firm*—Eric R. Pellenbarg; Phelps Dunbar LLP

(57) ABSTRACT

A chain link fence slat system comprising a plurality of slats and a channel. Each slat is elongated and has a longitudinal dimension with a first and a second end, a width dimension and a thickness dimension less than the width dimension. Each slat further has at least a first and a second notch formed near the first end of the slat, each of the notches being formed on opposite sides of the width dimension and extending across the width dimension and partly through the thickness dimension. The first notch is positioned at a first vertical height and the second notch is positioned at a second vertical height with the second vertical height being greater than the first vertical height. The channel receives one end of each slat. The channel has inner surfaces including a base portion, a first opposing wall and a second opposing wall. The first opposing wall has a first inwardly projecting barb for receiving the first notch of a slat and the second opposing wall has a second inwardly projecting barb for receiving the second notch of a slat. The spacing between the first and second opposing walls being equal to or greater than the thickness dimension of the slat.

12 Claims, 9 Drawing Sheets

UNIVERSAL RETAINING LOCK FOR CHAIN LINK FENCE SLATS

FIELD OF THE INVENTION

The present invention generally relates to privacy slats for chain link fencing systems, and in particular to an improved design for a universal retaining lock for chain link privacy slats which permits the locking channel to be installed in a variety of orientations.

BACKGROUND OF THE INVENTION

Chain link fencing is a commonly used and practical solution for many fencing applications. However, given the inherent transparency of chain link fencing, users often opt to install some sort of privacy slat system in order to make the installed fencing less transparent to outside observers. A typical chain link privacy slat system will include slats which are inserted through the links of the fencing system as well as some sort of locking mechanism which serves to secure the slats in place and prevent them from falling out of the fencing or otherwise shifting position. Typically, such fencing slat systems are fabricated from plastics including polyethylene, PVC and the like. The slats and locking channels can be extruded or formed by other methods known in the art. In the industry, privacy slat systems are referred to generally by the vertical location of the locking mechanism. For example, a locking mechanism located toward the bottom of the fence (i.e., near the ground) is typically referred to as a "bottom-lock" system. Conversely, a system in which the locking mechanism is located toward the top rail of the fence is typically referred to as a "top-lock" system. Typical top-lock systems utilize cutouts in the slats to pass a retaining member through in order to prevent slippage of the slats. There are currently no systems which permit the locking mechanism to be utilized as either a top or bottom lock without any modification to the slats or locking mechanism itself.

The area of chain link fencing privacy slats has remained relatively stagnant for the past several decades. Examples of chain link privacy slat systems can be found, for example, in U.S. Pat. No. 4,725,044 to Cluff and U.S. Pat. No. 4,995,591 to Humphrey, et al. Cluff teaches a privacy slat system employing slats and locking clips to retain the slats within the fencing system. Although a workable product, in practical application the installation of a Cluff-like system is time consuming given that each slat requires an individual clip to be attached manually. Humphrey et al. sought to improve upon the Cluff design by utilizing a locking channel in a bottom-lock system. The Humphrey system speeds installation as it permits multiple slats to be inserted into one channel member. However, the Humphrey system's requirement to have barbs on both terminal edges of the channel make it impractical to use a Humphrey channel as a top-lock mechanism as the Humphrey design is not strong enough to support slats in a top-lock orientation. Additionally, the inclusion of an additional retention slot on a Humphrey slat would cause the slat to lose its strength given that the retention slats would have to be located at directly opposing sides of the slat, cutting through virtually the entire width of the slat.

Thus there exists a need for a universal retaining lock for chain link privacy slats which can be installed in both a top lock and bottom lock orientation without modification to the retaining lock itself. There also exists a need for a method of installing the same.

BRIEF SUMMARY OF THE INVENTION

The present invention discloses a universal privacy slat system for use in chain link fencing. The locking mechanism and slats of the present invention can be employed in either a top lock or bottom lock configuration without requiring modification to either portion of the system. Unlike previously disclosed chain link privacy slat systems, the present invention preserves the structural integrity of the slats employed and at the same time provides a locking mechanism with sufficient strength to support the slats in a top lock configuration.

The present invention also contemplates a plurality of slats inserted vertically through adjacent rows of fencing links, each slat being elongated and having a longitudinal dimension with spaced opposite ends, a width dimension, a thickness dimension less than the width dimension, and each slat having at least a first end and a second notch formed near one end of said slat, each of said first and said second notches being formed on opposite sides of said width dimension and extending across the width dimension and partly through the thickness dimension, said first notch positioned at a first vertical height and said second notch positioned at a second vertical height, said second vertical height being greater than said first vertical height and a channel inserted through the fencing in a horizontal orientation to receive perpendicularly the ends of the slats having the notches formed nearby, said channel having inner surfaces and including a base portion, a first opposing wall and a second opposing wall, wherein each of said first and second opposing walls includes in an inwardly projecting barb displaced in a manner such that the barb on said first opposing wall vertically corresponds with said first notch in said slat and the barb on said second opposing wall vertically corresponds with said second notch in said slat, the spacing between said opposing walls being equal to or less than the slat thickness dimension and each inwardly projecting barb being engageable with the corresponding first or second notch so as to lock said slat to the channel.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout the several views of the drawings.

DETAILED DESCRIPTION OF THE INVENTION

Figure 1:
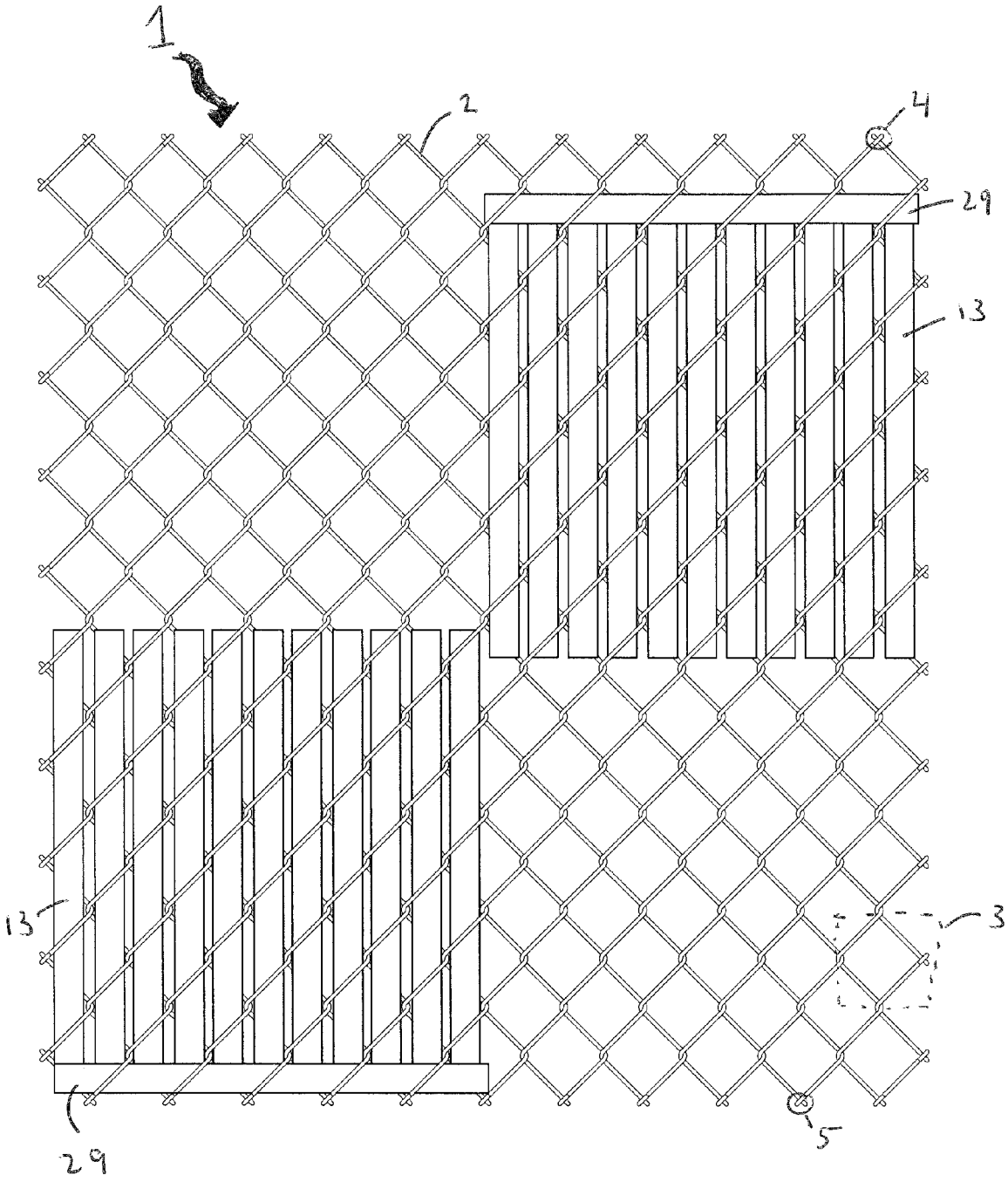
FIG. 1 is a fragmentary elevational view of a section of typical chain link fencing, partially cut away, showing the slat and channel assembly of this invention installed within the fencing in a bottom lock configuration.
Figure 7:
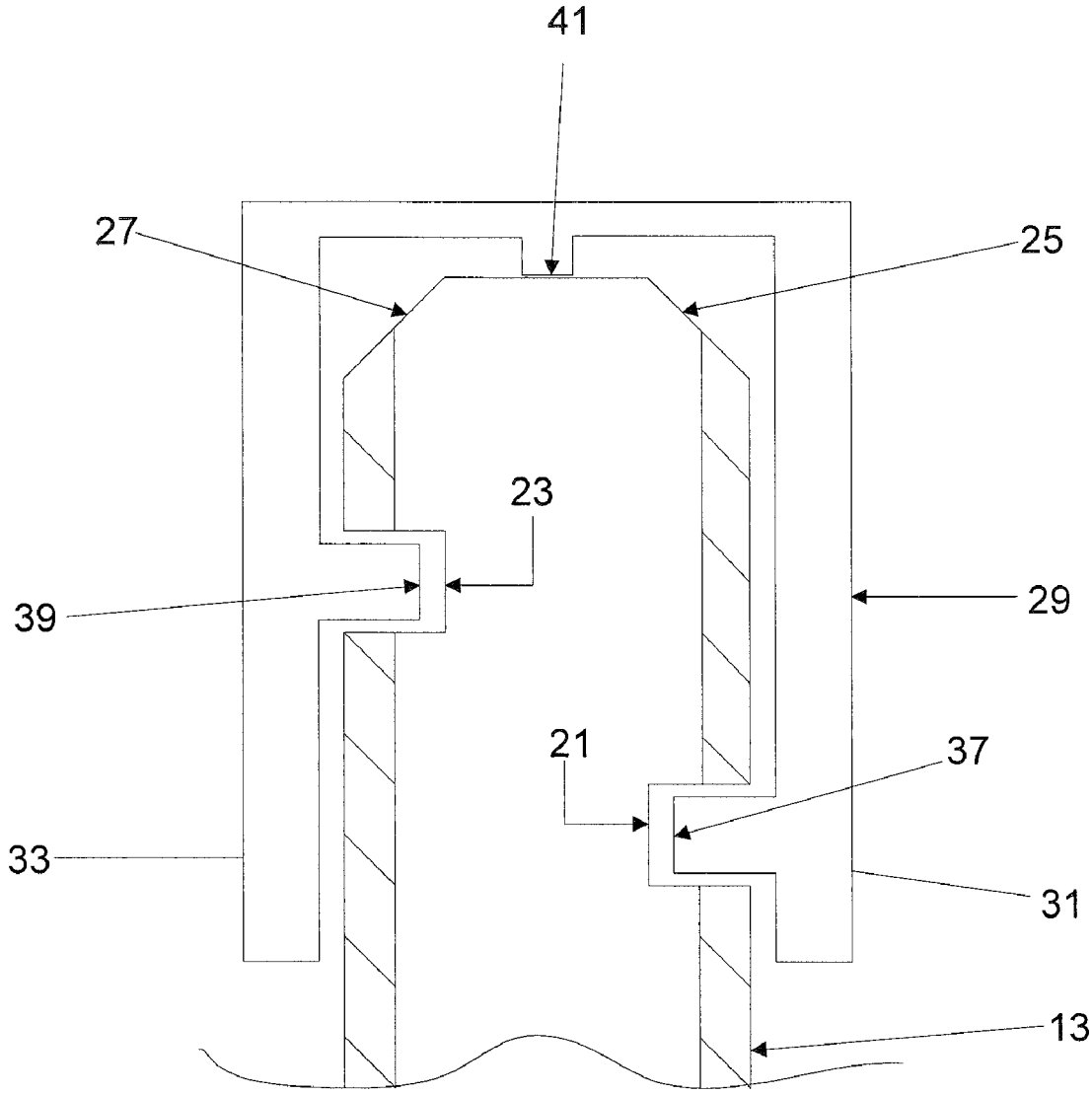
FIG. 7 is a cross sectional view of the privacy slat as illustrated in FIG. 3 interacting with the locking channel as illustrated in FIG. 4 taken along the 1'-1' line from FIG. 1 shown in a top lock configuration.

Typical chain link privacy slat systems employ slats which are inserted in the chain link fencing along with some form of locking mechanism to secure the slats to the fence and prevent movement or slippage. FIG. 1 illustrates the present invention as used in a bottom lock configuration with typical chain link fencing. A chain link fence 1 consists of a series of wires 2, each of which is bent into a series of segments 3. Each segment 3 being formed at right angles to the next. The wires 2 are interwoven with each other to form a mesh of rectangular openings, such openings being generally square. The wires 2 are twisted or linked together at the top 4 and bottom 5 of the fencing. A fence slat 13 (or a plurality of slats) can be inserted vertically into the fence 1 by weaving the slat 13 in between alternating wires 2. In a bottom lock configuration, a channel 29 can be inserted into the last row of segments 3 formed by the wires 2. In a top lock configuration (as shown in FIG. 7), channel 29 can be inserted into the topmost row of segments 12 formed by the wires 2. It is also contemplated by this invention to insert the fence slat 13 at an angle corresponding to the angle made by the segments 3 (typically 45 degrees) or to insert the fence slat in a horizontal fashion (that is, parallel to the ground) if desired.

Figure 2:
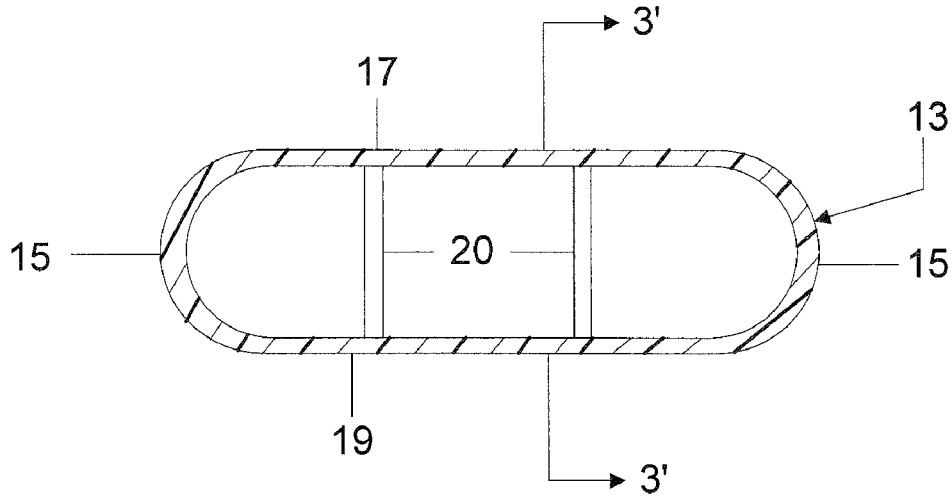
FIG. 2 is a cross sectional view of a typical privacy slat as contemplated by the current invention.

FIG. 2 shows a cross sectional view of a fence slat 13 as contemplated by the present invention. In a preferred embodiment, the slat 13 has rounded ends 15 and flattened sides 17 and 19. Slat 13 is typically extruded from various plastic materials and may also contain additional support ribs 20.

Figure 3:
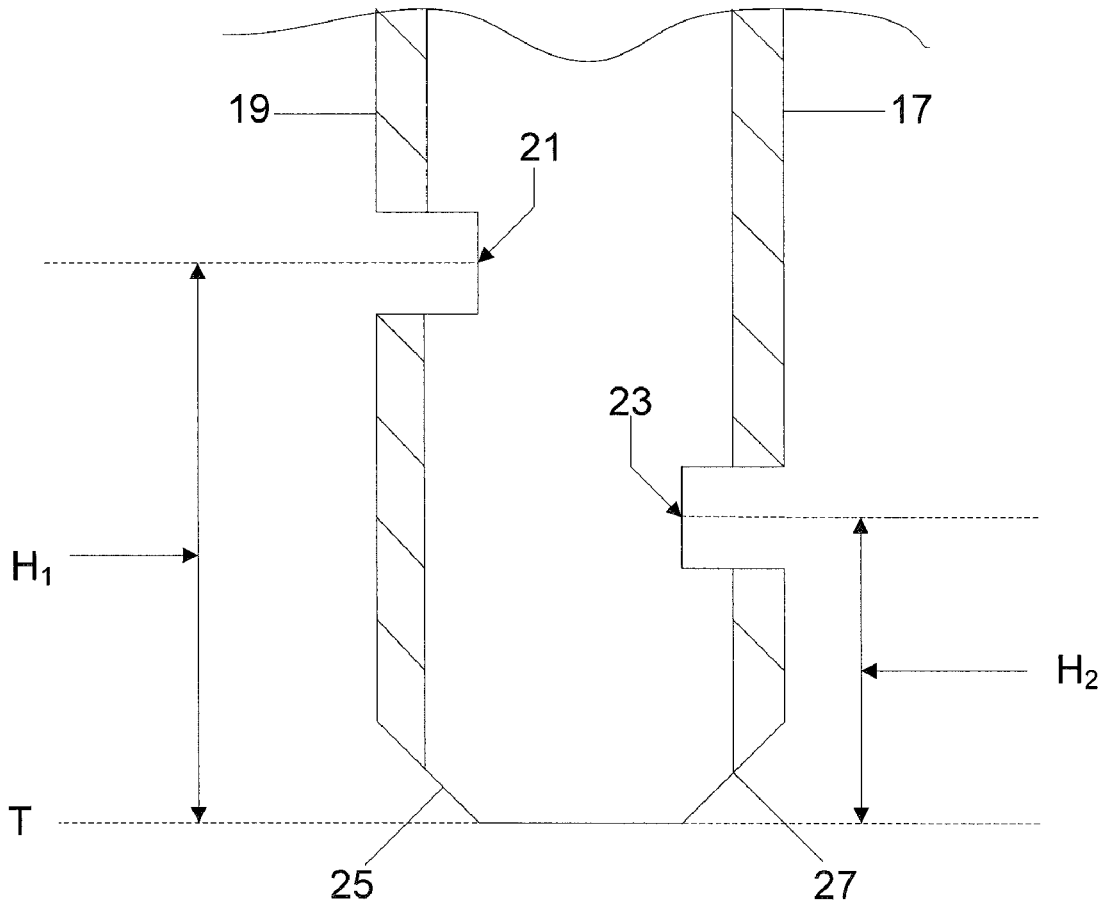
FIG. 3 is a cross sectional view of the privacy slat depicted in FIG. 2 taken along the 3'-3' line.

FIG. 3 illustrates a fragmentary cross sectional view of a fence slat 13 contemplated by the present invention taken along the 3'-3' line of FIG. 2. The slat preferably contains at least two notches, 21 and 23, each located on opposing side of the slat 13. Although the interior surfaces of notches 21 and 23 are herein illustrated as being substantially squared off, it is contemplated by this invention that the interior surfaces of notches 21 and 23 could be rounded, scalloped or any other shape which produces the desired effect of engaging with the locking mechanism described below. Notches 21 and 23 are preferably located at different vertical heights from the terminal end plane T of slat 13. For example, in FIG. 3, the midpoint of notch 21 is located at a distance $H_1$ from the terminal end plane T of slat 13. Likewise the midpoint of notch 23 is located at a distance $H_2$ from the terminal end plane T of slat 13. The difference between $H_1$ and $H_2$ is preferably sufficient enough to prevent structural degradation of slat 13. Slat 13 can also contain one or more beveled edges 25 and 27 to aid the insertion of the slat 13 into the locking mechanism described below. It is also contemplated by this invention to provide more than two notches, each at varying vertical heights from the terminal end plane T of the slat 13. In a preferred embodiment based on a channel 29 having a height $H_3$ of one inch, $H_1$ can range from 0.40 inches to 0.80 inches with 0.50 inches being most preferable. Similarly, $H_2$ can range from 0.10 inches to 0.35 inches with 0.25 inches being most preferable. The value of $H_1$ and $H_2$ can encompass numerous combinations provided that the difference between $H_1$ and $H_2$ remains sufficient enough to ensure the structural integrity of slat 13. Additionally, the value of $H_1$ and $H_2$ can be adjusted accordingly if a channel 29 of varied height $H_3$ is employed. Further, should an angled insertion of slat 13 be desired (as in the situation where slat 13 is installed at an angle corresponding to that made by the segments 3), slat 13 would have correspondingly beveled ends.

Figure 4:
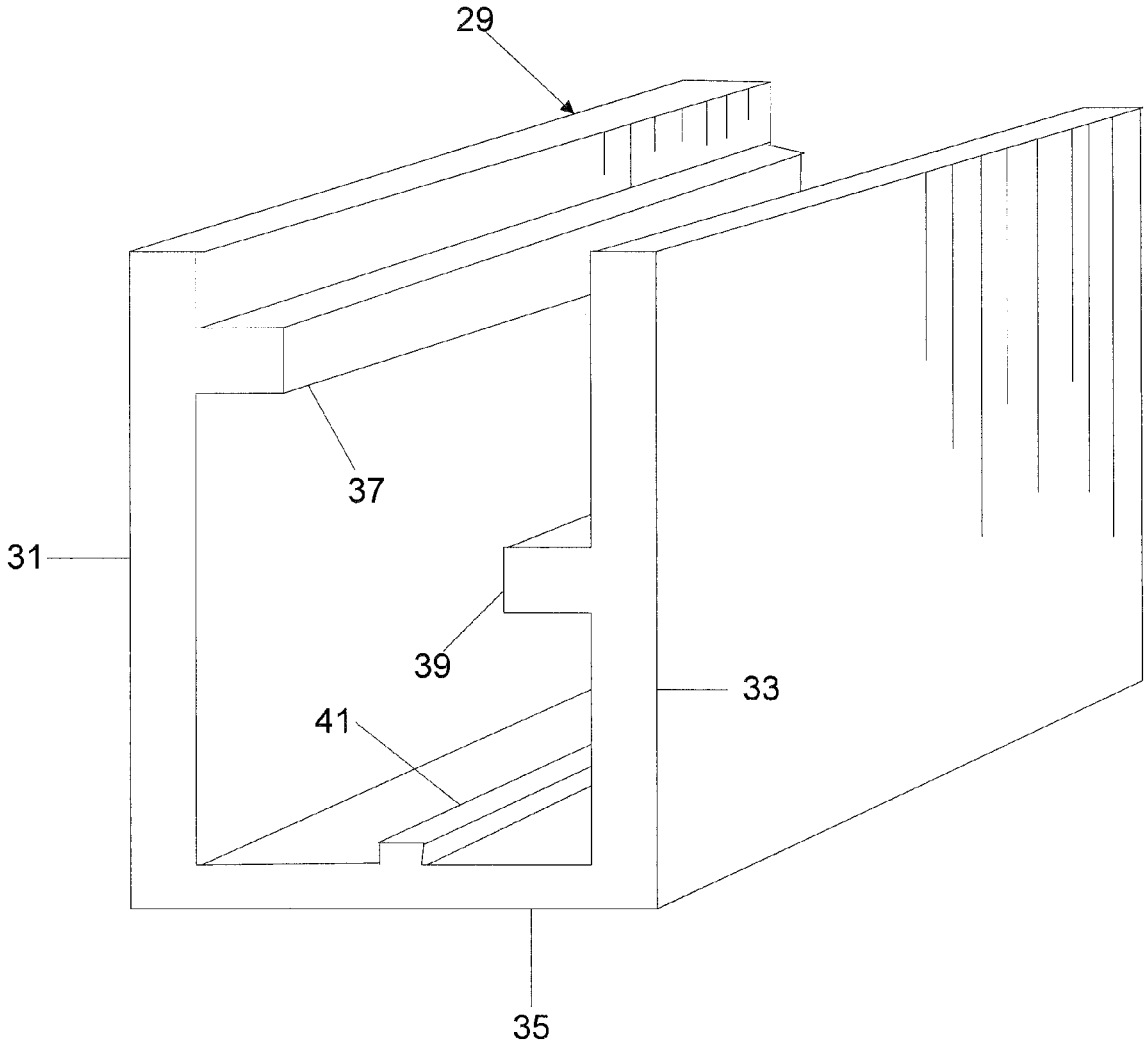
FIG. 4 is a perspective view of a locking channel for use in a chain link privacy slat system as contemplated by the current invention.

FIG. 4 illustrates a channel 29 as contemplated by a preferred embodiment of the present invention. Channel 29 comprises walls 31 and 33 which extend perpendicularly from base portion 35. In a preferred embodiment, wall 31 and wall 33 each contain an inwardly facing barb, 37 and 39 respectively. Additionally, in some embodiments, the base portion 35 can include a raised portion 41 which acts to provide space between the terminal end of slat 13 and the inner surface of base portion 35. Such space is advantageous, for example when channel 29 is installed in a bottom lock configuration as the space permits water to drain out of the channel 29 more easily. It is also possible to use more than one raised portion 41 on base portion 35 depending on the number and arrangement of beveled edges 25 and 27. Channel 29 can be made from any material, but is typically made via extrusion of a plastic. In a preferred embodiment, channel 29 is made from polyvinylchloride (PVC) to take advantage of the increased strength and rigidity PVC provides in fence slat related applications.

Figure 5:
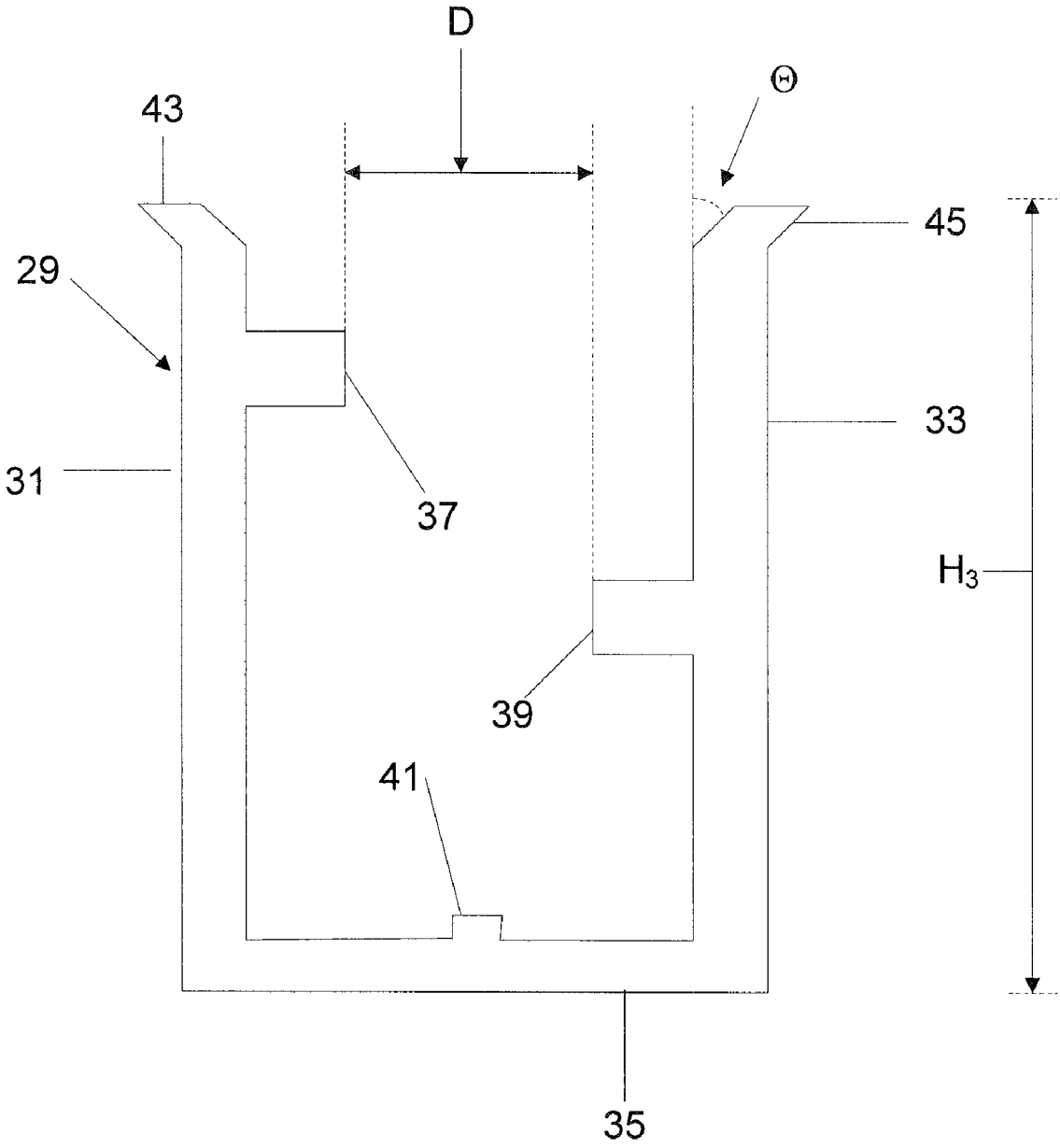
FIG. 5 is a cross sectional view of one embodiment of a locking channel for use in a chain link privacy slat system as contemplated by the current invention.

FIG. 5 illustrates a cross sectional view of a channel 29 as contemplated by the present invention. In a preferred embodiment, the distance D between the terminal ends of barbs 37 and 39 is less than the distance between the sides 17 and 19 of slat 13 to permit engagement of the barbs 37 and 39 with notches 21 and 23. In some embodiments of the present invention walls 31 and 33 can each have a flared portions 43 and 45 respectively. Flared portions 43 and 45 can act to guide the insertion of slat 13 into channel 29 during installation. It is not necessary that both walls 31 and 33 have a flared portion as the addition of one flared portion is still within the scope of this invention. Flared portions 43 and 45 can have any angle of flare θ however in application angles of between 1 and 45 degrees provide optimal performance. An angle of flare θ greater than 45 degrees is still within the ambit of this invention. Channel 29 has a height, $H_3$ which is limited by the size of the segments 3 in the fence 1. In a preferred embodiment of the present invention, $H_3$ is approximately one inch.

Figure 6:
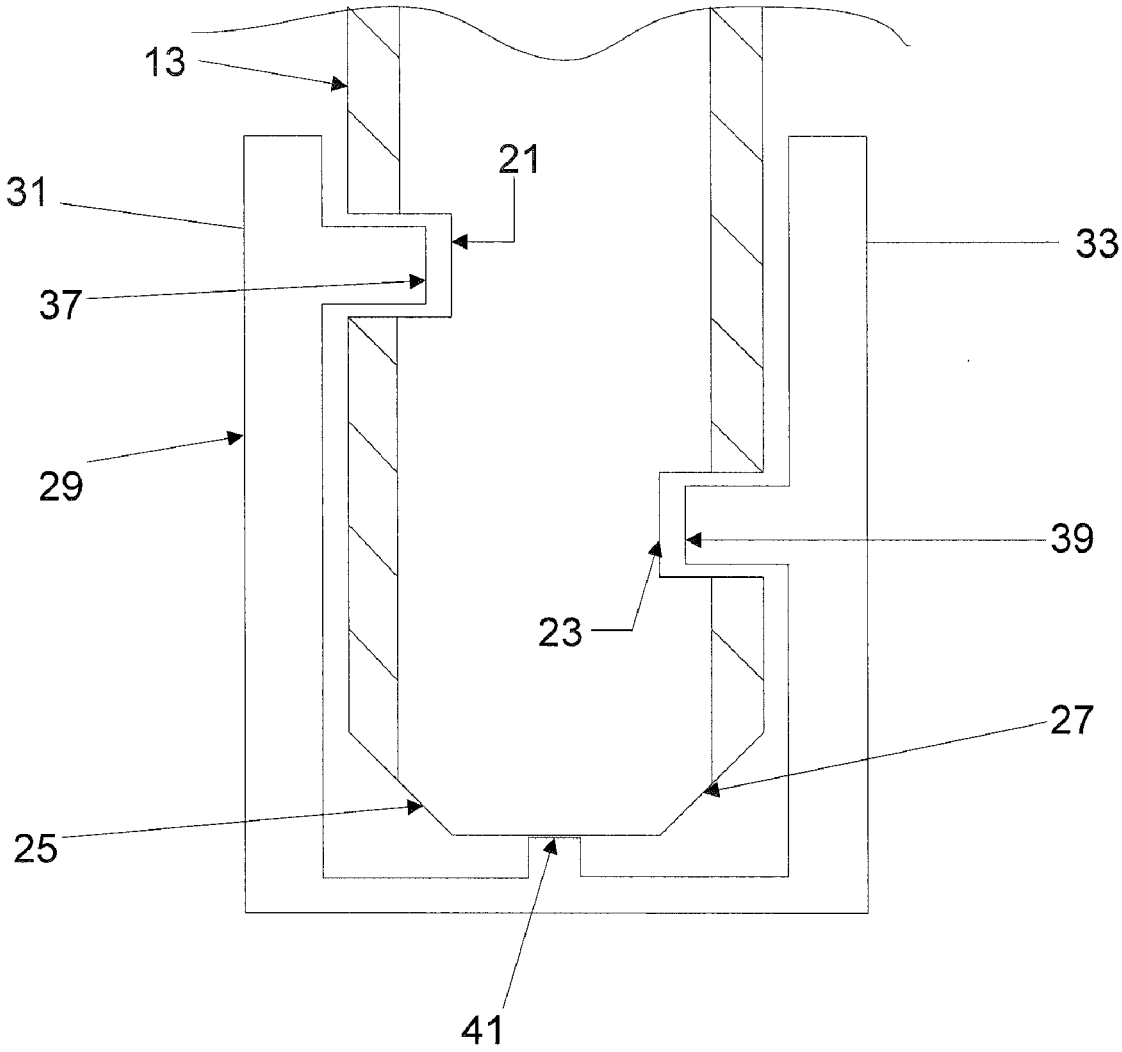
FIG. 6 is a cross sectional view of the privacy slat as illustrated in FIG. 3 interacting with the locking channel as illustrated in FIG. 4 taken along the 1'-1' line from FIG. 1 shown in a bottom lock configuration.

FIG. 6 shows the interaction between a slat 13 and channel 29 as contemplated by the present invention when installed in a bottom lock configuration. In typical installations, a channel 29 is first inserted into the bottom most rung of chain links, thereby retaining the channel 29 within the chain link fence. After each slat 13 is passed through the chain link fencing material (typically by weaving the slat 13 through every other segment 3), the slat 13 can be inserted into the channel 29 through the application of pressure sufficient enough to spread walls 31 and 33 apart and allow slat 13 to pass in between. As channel 29 is typically made from a resilient material such as polyethylene, PVC or the like walls 31 and 33 will flex and allow slat 13 to slide into the channel 29. Upon insertion, notches 21 and 23 will eventually come into the same vertical plane as barbs 37 and 39. At this point, walls 31 and 33 will flex back toward their pre-insertion position and allow barbs 37 and 39 to engage with notches 21 and 23, thereby fixing slat 13 into place. Raised portion 41 acts to assist barbs 37 and 39 in arresting the movement of slat 13 and also provides drainage access if channel 29 is inserted in a bottom lock orientation. If utilized, flared portions 43 and 45 (as shown in FIG. 5) can assist the installer with guiding slat 13 into channel 29.

FIG. 7 illustrates the use of channel 29 in a top lock configuration. Installation of slat 13 and channel 29 is similar to that depicted in FIG. 6; however, the channel 29 is typically installed into the uppermost chain link segment 3. The terminal ends of walls 31 and 33 thus face downward toward the ground and slat 13 is installed upwardly into channel 29. Alternatively, slat 13 can be installed into the chain link fencing first followed by channel 29. Slat 13 can then be inserted into channel 29 to engage barbs 37 and 39 with notches 21 and 23. If utilized, flared portions 43 and 45 (as shown in FIG. 5) can assist the installer with guiding slat 13 into channel 29.

Figure 8:
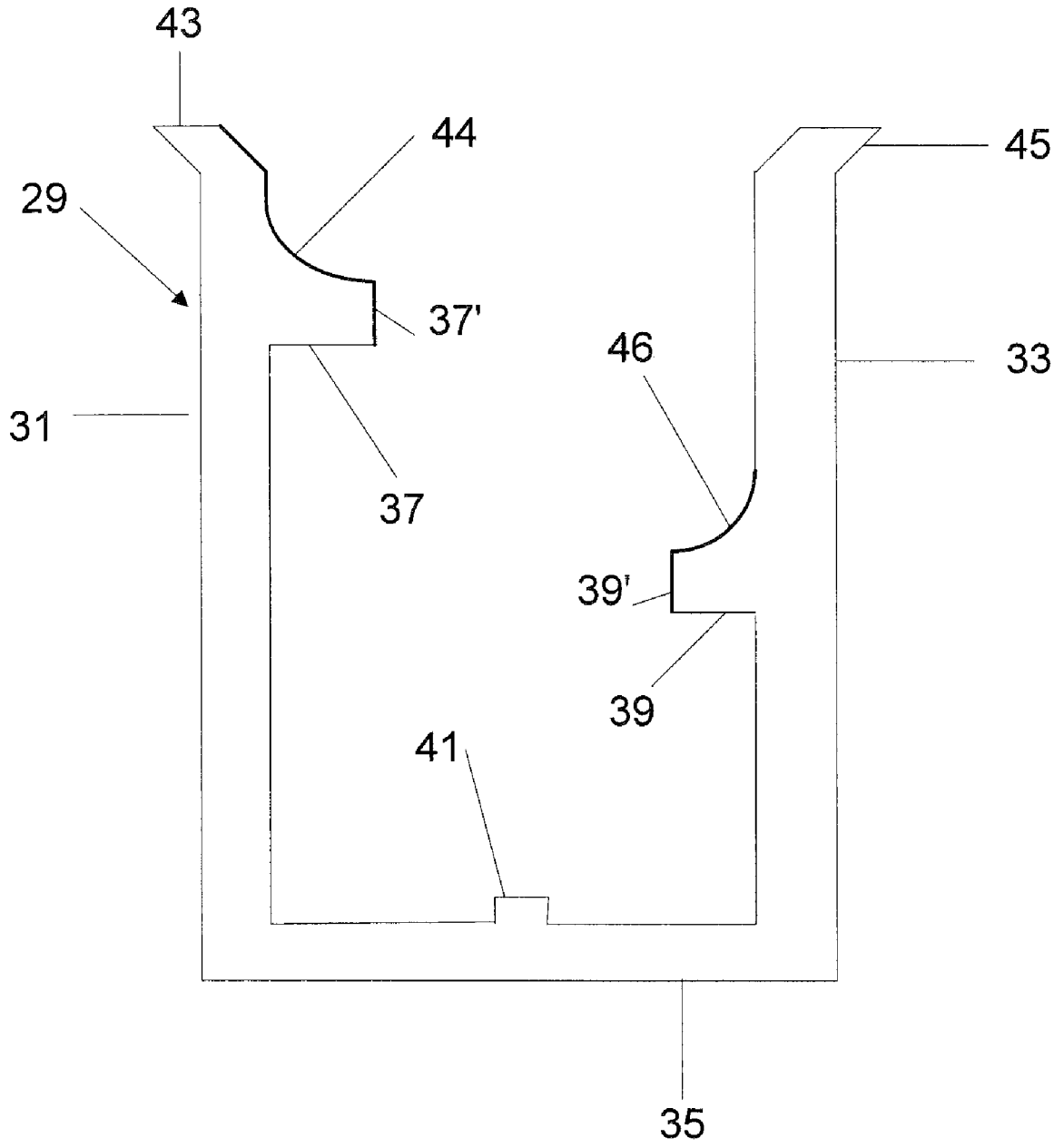
FIG. 8 is a cross sectional view of one embodiment of a locking channel for use in a chain link privacy slat system as contemplated by the current invention.

FIG. 8 illustrates a channel 29 of the present invention in which barb 37 and barb 39 contain sloped surfaces 44 and 46 respectfully, which aid in the installation of slat 13 into channel 29. In a preferred embodiment, sloped surface 44 and sloped surface 46 are formed during manufacture and connect the outer extremity 37' and 39' of barb 37 and barb 39 with the inner surface of wall 31 and wall 33, respectively. Sloped surfaces 44 and 46 can be sloped at any degree so as to assist in funneling slat 13 into channel 29 during installation.

Figure 9:
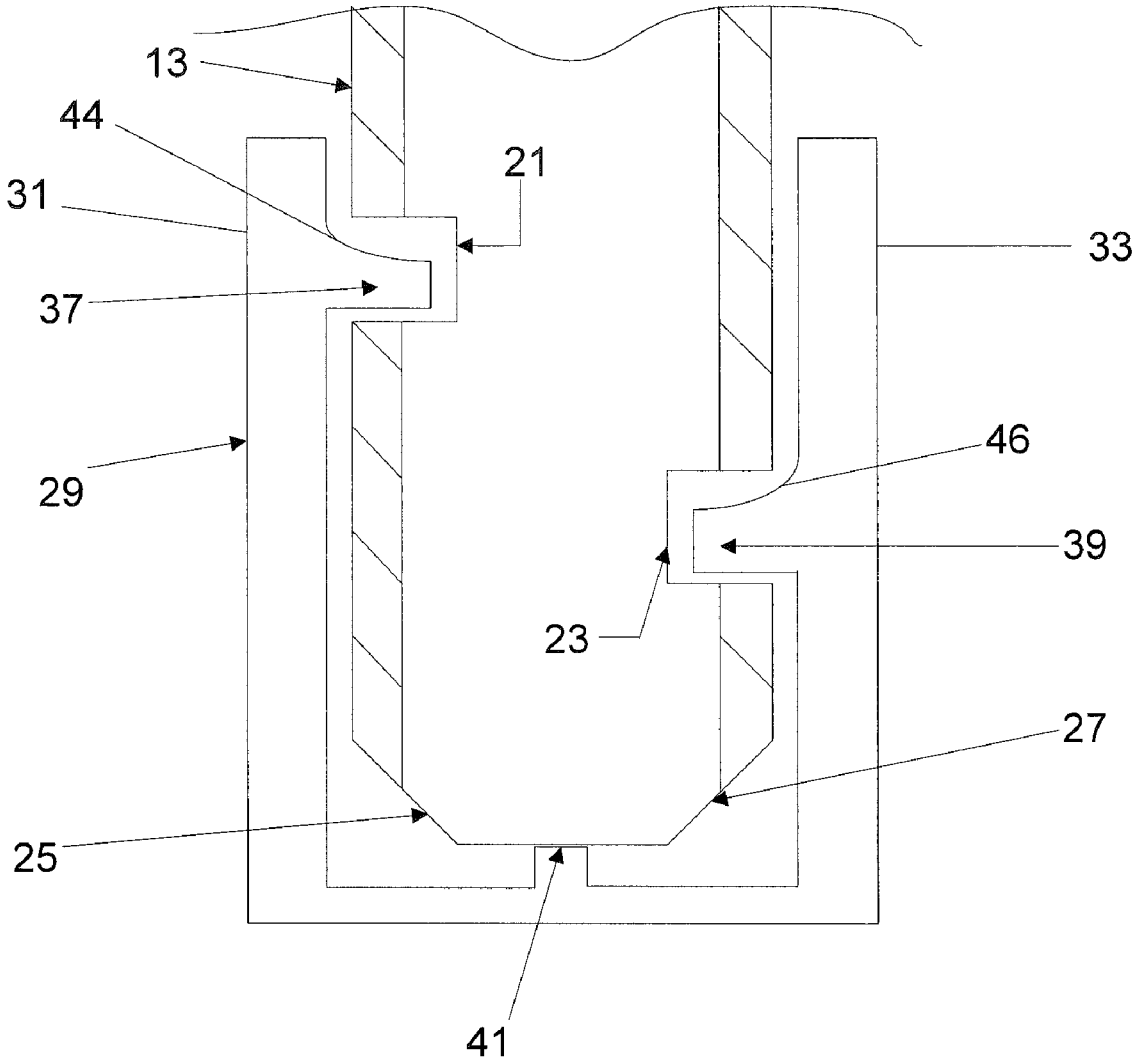
FIG. 9 is a cross sectional view of the locking channel illustrated in FIG. 8 interacting with a slat as contemplated by the current invention.

FIG. 9 illustrates an embodiment of the present invention showing the channel 29 including sloped surfaces 44 and 46 engaging with slat 13. During installation the engagement of beveled edges 25 and 27 with sloped surfaces 44 and 46 eases installation of slat 13 into channel 29.

Figure 10:
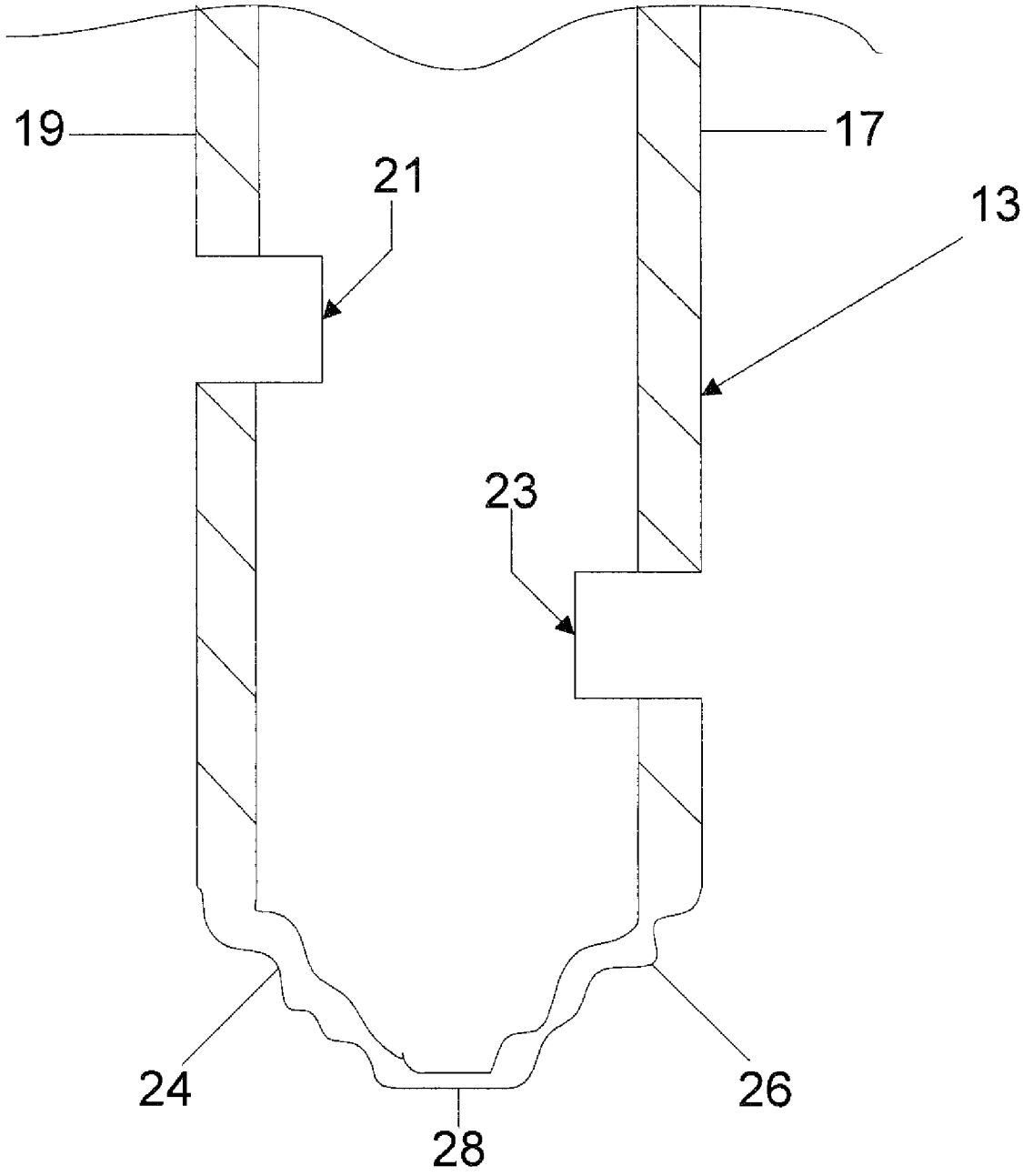
FIG. 10 is a cross sectional view of a slat according to the present invention containing a hard end point formed through a heat treatment process.

FIG. 10 illustrates an embodiment of a slat of the present invention wherein beveled edges 25 and 27 of FIG. 3 are instead replaced with heat treated edges 24 and 26. In a preferred embodiment, once slat 13 is cut to a desired overall length, the end (or ends) which is to be engaged with channel 29 is subjected to a heat treatment process. The heat treatment process can be employed using pinchers, a press or other equipment known in the art. The heat treatment process acts to fuse together the material constituting walls 17 and 19 and support ribs 20 (from FIG. 2) into a hard end point 28. Hard end point 28 can have a rough or smooth finish, depending on its desired characteristics. Given the collection of mass at hard end point 28 through the heat treatment process, hard end point 28 aids in the installation of slat 13 into channel 28. Heat treatment of slat 13 to form hard end point 28 has improved slat installation time and rigidity of the end of slat 13 inserted into channel 29.

It is understood that the above description is intended to be illustrative and not restrictive. Although various characteristics and advantages of certain embodiments of the present invention have been highlighted herein, many other embodiments will be apparent to those skilled in the art without deviating from the scope and spirit of the invention disclosed. The scope of the invention should therefore be determined with reference to the claims contained herewith as well as the full scope of equivalents to which said claims are entitled.

Now that the invention has been described,

What is claimed is:

1. A chain link fence slat system comprising:

a plurality of slats, each slat being elongated and having a longitudinal dimension with a first and a second end, a width dimension, a thickness dimension less than the width dimension, and each slat having at least a first and a second notch formed near said first end of said slat, each of said first and said second notches being formed on opposite sides of said width dimension and extending across the width dimension and partly through the thickness dimension, said first notch positioned at a first vertical height and said second notch positioned at a second vertical height, said second vertical height being greater than said first vertical height; and a channel to receive one end of each slat, said channel having inner surfaces and including a base portion having an inner surface and a raised portion, said raised portion forming a space between said first end of said slat and said inner surface of said base portion, a first opposing wall and a second opposing wall, said first opposing wall having a first inwardly projecting barb for receiving said first notch and said second opposing wall having a second inwardly projecting barb for receiving said second notch, the spacing between said first and said second opposing walls being equal to or greater than said thickness dimension of said slat.

2. The chain link fence slat system of claim 1 wherein said first end of said slat contains at least one beveled edge.

3. The chain link fence slat system of claim 1 wherein said first end of said slat contains at least two beveled edges.

4. The chain link fence slat system of claim 1 wherein said first and second opposing walls each terminate in a flared portion.

5. The chain link fence slat system of claim 4 wherein said flared portions flare at an angle between 0 and 45 degrees.

6. The chain link fence slat system of claim 1 wherein said channel has a height of between 0.50 inches and 2.50 inches.

7. The chain link fence slat system of claim 1 wherein said channel is manufactured from polyvinylchloride.

8. The chain link fence slat system of claim 7 wherein said first vertical height is between 0.1 inches and 0.35 inches.

9. The chain link fence slat system of claim 8 wherein said second vertical height is between 0.40 inches and 0.80 inches.

10. The chain link fence slat system of claim 1 wherein said first inwardly projecting barb further contains a sloped surface.

11. The chain link fence slat system of claim 10 wherein said second inwardly projecting barb further contains a sloped surface.

12. The chain link fence slat system of claim 1 wherein aid first end of said slat further contains a hard end point.

* * * * *